US005558048A

United States Patent [19]

Suzuki et al.

[11] Patent Number: 5,558,048

[45] Date of Patent: Sep. 24, 1996

[54] CYLINDER BLOCK COOLING ARRANGEMENT

[75] Inventors: Makoto Suzuki; Shizuo Abe; Masato Kawauchi, all of Mishima, Japan

[73] Assignee: Toyota Jidosha Kabushiki Kaisha, Aichi, Japan

[21] Appl. No.: 402,818

[22] Filed: Mar. 13, 1995

[30] Foreign Application Priority Data

Mar. 18, 1994 [JP] Japan ..... 6-048388

[51] Int. Cl.[6] ..... F02B 75/18

[52] U.S. Cl. ..... 123/41.24; 123/41.79

[58] Field of Search ..... 123/41.74, 41.72, 123/41.79

[56] References Cited

U.S. PATENT DOCUMENTS

| | | | |
|---|---|---|---|
| 3,942,487 | 3/1976 | Zink | 123/41.74 |
| 4,759,317 | 7/1988 | Ampferer | 123/41.74 |
| 5,052,348 | 10/1991 | Takakura et al. | 123/41.74 |
| 5,386,805 | 2/1995 | Abe et al. | 123/41.79 |

FOREIGN PATENT DOCUMENTS

| | | |
|---|---|---|
| 4-27710 | 1/1992 | Japan . |
| 4-214951 | 8/1992 | Japan . |
| 5-141307 | 6/1993 | Japan . |
| 5-149134 | 6/1993 | Japan . |
| 6-18640 | 3/1994 | Japan . |

*Primary Examiner*—Noah P. Kamen
*Attorney, Agent, or Firm*—Oliff & Berridge

[57] ABSTRACT

A cooling system for an engine having a plurality of cylinder bores which are arranged along a longitudinal axis. First and second coolant passages continuously extend along the periphery of the bores on each side of the axis, extending from the bore arranged in one end of the engine to the bore arranged in another end of the engine. The first and the second passages are connected to each other by a connector at one end of the engine. Intermediate walls are formed between adjacent bores. A connecting passage is formed in each intermediate wall for connecting the first and the second coolant passages. Water as a coolant flows from an inlet, which is formed at the other end of the first coolant passage, through, in turn, the first coolant passage, the connector, and the second coolant passage, and flows out from an outlet, which is formed at the other end of the second coolant passage. Water also flows through the connecting passages.

27 Claims, 16 Drawing Sheets

CYLINDER BLOCK COOLING ARRANGEMENT

BACKGROUND OF THE INVENTION

1. Field of the Invention

The present invention relates to a cooling system for an engine.

2. Description of the Related Art

Japanese unexamined patent publication No. 4-214951 discloses a cooling system for an engine having a plurality of cylinder bores which are arranged along a longitudinal axis of the engine. The system is provided with a first coolant passage continuously extending, on one side of the axis, from the bore arranged in one end of the engine to the bore arranged in another end of the engine along the periphery of the bores; a second coolant passage continuously extending, on the other side of the axis, from the bore arranged in the one end of the engine to the bore arranged in the other end of the engine along the periphery of the bores; a connector for connecting the ends of the first and the second coolant passages located at the one end of the engine; a coolant inlet formed at the end of the first coolant passage located at the other end of the engine; and a coolant outlet formed at the end of the second coolant passage located at the other end of the engine. A coolant flows from the inlet through, in turn, the first passage, the connector, and the second coolant passage, and flows out from the outlet.

An intermediate wall is provided between every two adjacent bores. However, in the system described above, the intermediate walls are not cooled sufficiently. Therefore, it is difficult to reduce undesirable deformation of the bores.

SUMMARY OF THE INVENTION

An object of the present invention is to provide a cooling system for an engine which reduces the deformation of the cylinder bores.

According to one aspect of the present invention, a cooling system is provided for an engine having a plurality of cylinder bores which are arranged along a longitudinal axis of the engine. An intermediate wall is provided between every two adjacent bores. The system comprises: a first coolant passage continuously extending, on one side of the axis, from the bore arranged in one end of the engine to the bore arranged in the other end of the engine along the periphery of the bores; a second coolant passage continuously extending, in the other side of the axis, from the bore arranged in the one end of the engine to the bore arranged in the other end of the engine along the periphery of the bores; a connector for connecting the ends of the first and the second coolant passages located at the one end of the engine; a coolant inlet formed at the end of the first coolant passage located at the other end of the engine; a coolant outlet formed at the end of the second coolant passage located at the other end of the engine; and a connecting passage formed in at least one intermediate wall for connecting the first and the second coolant passages to each other. A coolant flows from the coolant inlet through, in turn, the first coolant passage, the connector, and the second coolant passage, and flows out from the coolant outlet. The coolant also flows through the connecting passage.

According to another aspect of the present invention, a cooling system is provided for an engine having a plurality of cylinder bores which are arranged along a longitudinal axis of the engine. An intermediate wall is provided between every two adjacent bores. The engine has a cylinder head. The system comprises: a first coolant passage continuously extending, on another side of the axis, from the bore arranged in the one end of the engine to the bore arranged in the other end of the engine along the periphery of the bores; a second coolant passage continuously extending, in another side of the axis, from the bore arranged in the one end of the engine to the bore arranged in the other end of the engine along the periphery of the bores; a connector for connecting the ends of the first and the second coolant passages located the one end of the engine; a coolant inlet formed at the end of the first coolant passage located at the other end of the engine; a coolant outlet formed at the end of the second coolant passage located at the other end of the engine; a cylinder head coolant passage formed in the cylinder head; and a conducting passage in each intermediate wall for connecting either the first or the second coolant passage to the cylinder head coolant passage. Each of the conducting passage extends from either the first or the second coolant passage over substantially the entire length of the intermediate wall, and to the cylinder head coolant passage. A coolant flows from the coolent inlet through, in turn, the first coolant passage, the connector, and the second coolant passage, and flows out from the coolant outlet. The coolant also flows through the conducting passages.

These and other objects, features and advantages of the present invention will become more apparent from the description of the preferred embodiments of the invention set forth below, together with the accompanying drawings.

DESCRIPTION OF THE PREFERRED EMBODIMENTS

Figure 1A:
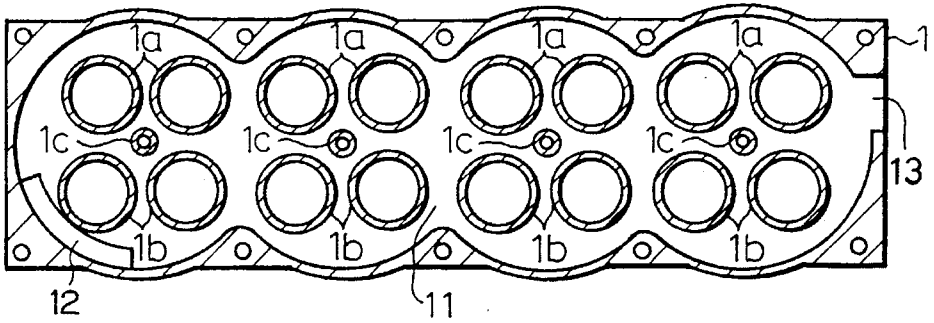
FIG. 1A is a cross sectional view of a cylinder head along the line IA—IA in FIG. 2.
Figure 1B:
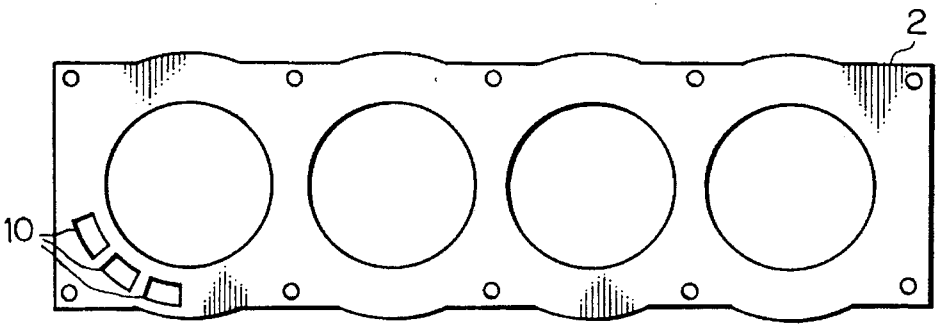
FIG. 1B is a top view of a gasket.
Figure 1C:
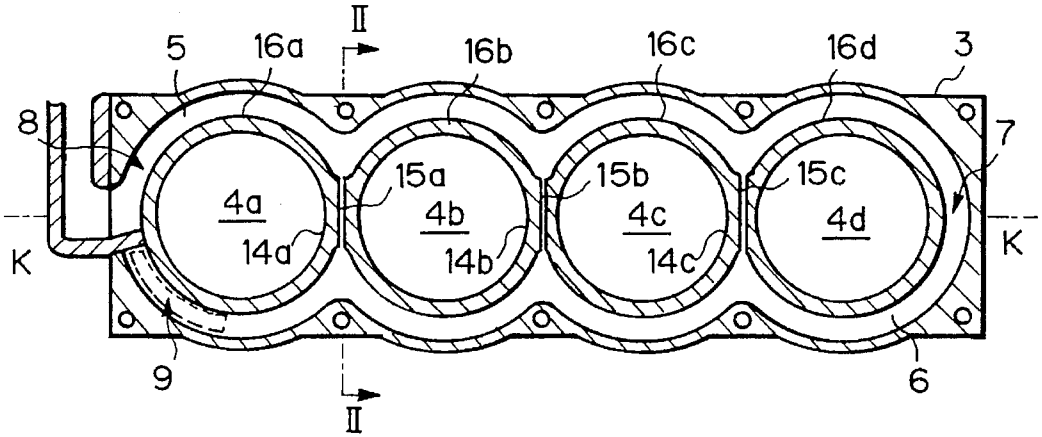
FIG. 1C is a cross sectional view of a cylinder block along the line IC—IC in FIG. 2.

A cooling system for an engine according to a first embodiment of the present invention is shown in FIG. 1A through FIG. 1C. FIG. 1A illustrates a cross sectional view of a cylinder head 1 of the engine along the line IA—IA in FIG. 2. FIG. 1B illustrates a top view of a gasket 2. FIG. 1C illustrates a cross sectional view of a cylinder block 3 of the engine along the line IC—IC in FIG. 2. The cylinder head 1 is fixed on the cylinder block 3 via the gasket 2.

Four cylinder bores 4*a*, 4*b*, 4*c*, 4*d* are arranged in the cylinder block 3 along a longitudinal axis K—K of the cylinder block 3. A cylinder wall 16*a* defines the first bore 4*a* and corresponding cylinder walls 16*b*, 16*c* and 16*d* define the second, the third and the fourth bores 4*b*, 4*c* and 4*d*, respectively. A first intermediate wall 14*a*, common to the cylinder walls 16*a* and 16*b*, extends between the first bore 4*a* and the second bore 4*b*. Similarly, a second intermediate wall 14*b* extends between the second bore 4*b* and the third bore 4*c*, and a third intermediate wall 14*c* extends between the third bore 4*c* and the fourth bore 4*d*. The second intermediate wall 14*b* is common to the cylinder walls 16*b* and 16*c*, and the third intermediate wall 14*c* is common to the cylinder walls 16*c* and 16*d*.

On the upper side of the axis K—K in FIG. 1C, a first coolant passage 5 continuously extends from the first bore 4*a*, located on the left end in the drawings, to the fourth bore 4*d*, located on right end, along the periphery of the walls 16*a*–16*d*. On the lower side of the axis K—K in FIG. 1C, a second coolant passage 6 continuously extends from the first bore 4*a* to the fourth bore 4*d* along the periphery of the walls 16*a*–16*d*. A connector 7 connects the first and the second passages 5 and 6 in series. The connector 7 extends along the periphery of the wall 4*d*.

At an opposite end of the first passage 5 relative to the connector 7, a coolant inlet 8 is provided. At an opposite end of the second passage 6 relative to the connector 7, a coolant outlet 9 is provided.

As shown in FIG. 1A, each cylinder in the cylinder head 1 has a pair of intake ports 1*a*, a pair of exhaust ports 1*b*, and a spark plug port 1*c*. A space between intake ports 1*a*, exhaust ports 1*b*, and spark plug ports 1*c* defines cylinder head coolant passage 11 formed in the cylinder head 1. A pressure drop in the cylinder head passage 11 is relatively large. The intake ports 1*a* are arranged substantially parallel to the axis K—K, on the upper side of the axis K—K. The exhaust ports 1*b* are arranged substantially parallel to the axis K—K, on the lower side of the axis K—K.

Figure 3:
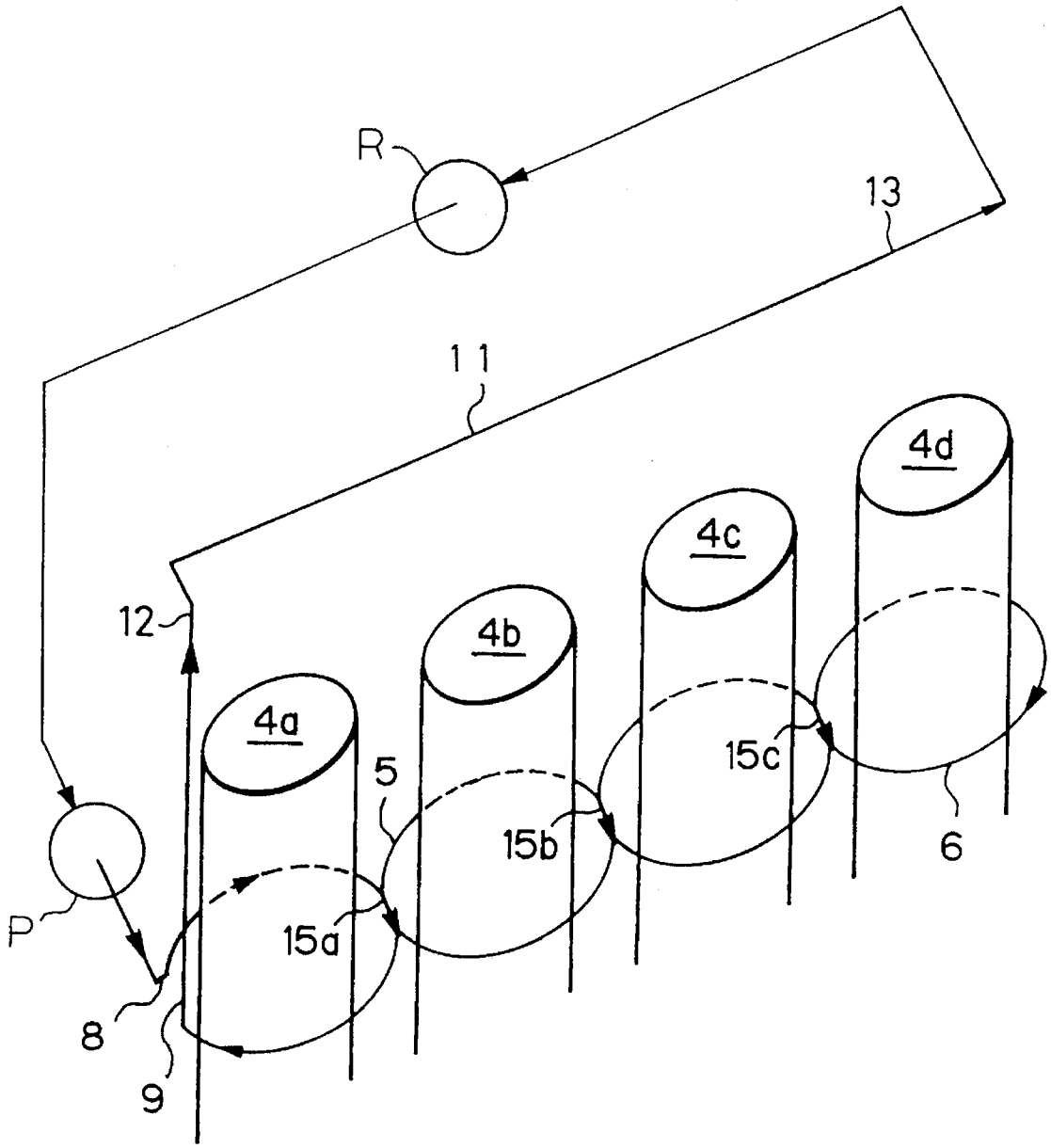
FIG. 3 is a schematic illustration showing a water flow in the system, according to a first embodiment of the present invention.

The cylinder head passage 11 is provided with a cylinder head passage inlet 12 formed at one end of the cylinder head 1, and a cylinder head passage outlet 13 formed at the other end of the cylinder head 1. Apertures 10 formed in the gasket 2 connect the outlet 9 to the cylinder head passage inlet 12. As shown in FIG. 3, the cylinder head passage outlet 13 is connected to an inlet of a coolant pump P via a radiator R for cooling the coolant. An outlet of the pump P is connected to the inlet 8. The pump P is driven by the engine. When the engine is driven, the coolant pumped by the pump P flows through, in turn, the first passage 5, the second passage 6, the cylinder head passage 11, and the radiator R. Accordingly, water is circulated through the system.

Figure 2:
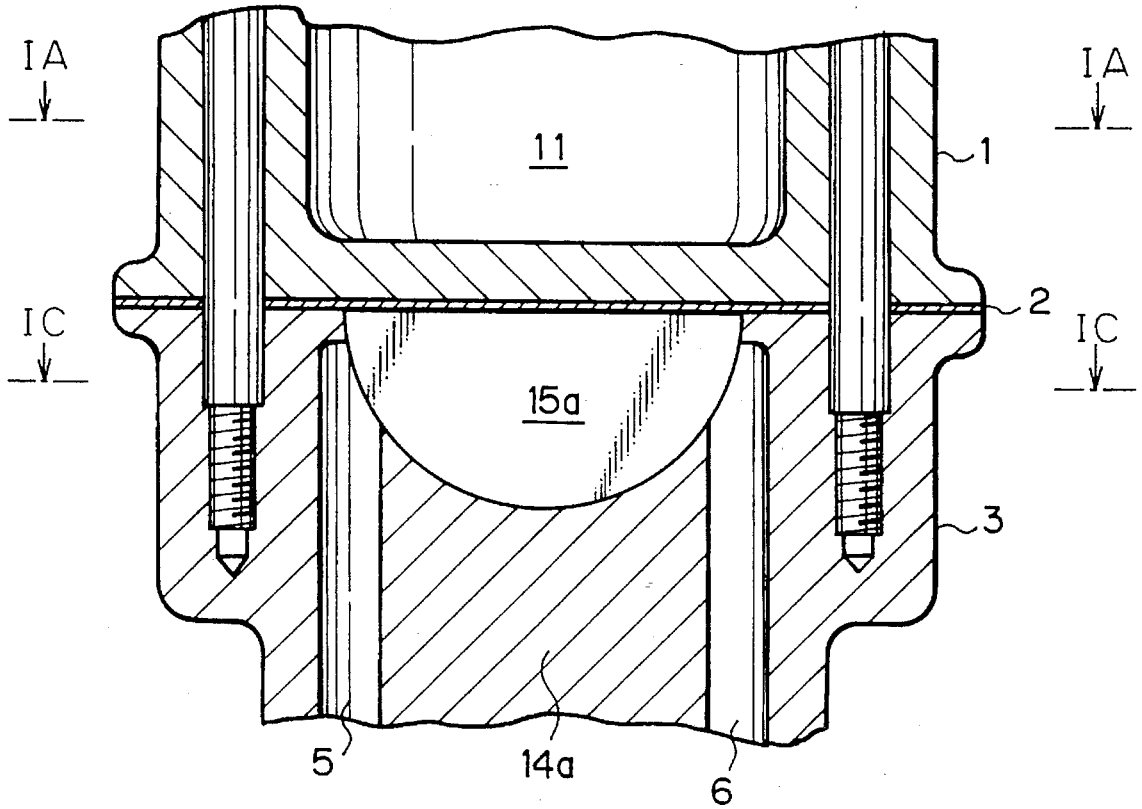
FIG. 2 is a cross sectional view of the cylinder head and the cylinder block along the line II—II in FIG. 1.

As shown in FIGS. 1C and 2, a first connecting passage 15*a* is formed in the first intermediate wall 14*a* for connecting the first and the second passages 5 and 6 to each other. Similarly, a second connecting passage 15*b* and a third connecting passage 15*c* are formed in the second and the third intermediate walls 14*b*, 14*c*, respectively.

Next, referring to FIG. 3, an operation of the system will be described.

When the engine is driven and thereby the pump is driven, water as a coolant is formed to flow into the first passage 5 through the inlet 8. The water flows through the first passage 5 from the first bore 4*a* toward the fourth bore 4*d*, and flows into the second passage 6 through the connector 7. Next, the water flows through the second passage 6 from the fourth bore 4*d* toward the first bore 4*a*. Finally, the water flows out through the outlet 9, and flows into the cylinder head passage 11 through the cylinder head passage inlet 12. The water cools the cylinder walls 16*a*–16*d* reducing the deformation of the cylinder walls 16*a*–16*d*.

Water also flows through each of the connecting passages 15*a*–15*c* from the first passage 5 to the second passage 6. The water cools the intermediate walls 14*a*–14*c* further reducing the deformation of the cylinder walls 16*a*–16*d*. Accordingly, friction between the cylinder walls 16*a*–16*d* and a corresponding piston of the engine (not shown) is reduced enhancing an output power of the engine and reducing the consumption of engine oil. Spaces formed between the cylinder walls 16*a*–16*d* and the corresponding piston are reduced thereby reducing an amount of a blow-by gas. Local temperature increases on the inner surfaces of the cylinder walls 16*a*–16*d* are also prevented.

In a known cooling system for the engine, the first and the second passages 5, 6 are connected in parallel so that the direction in which water flows through the first passage 5 and the direction in which water flows through the second passage 6 are substantially same. In the known system, the ends of the first and the second passages 5 and 6 adjacent to the first bore 4*a* are respectively connected to the pump, and the ends of the first and the second passages adjacent to the fourth bore 4*d* are respectively connected to, for example, cylinder head passage 11. In this arrangement, a temperature of water flowing through the first and the second passages rises as water flows toward the fourth bore 4*d* and the fourth wall 16*d*, which is situated downstream in the water flow, is difficult to cool sufficiently.

Further, the pressure difference between the first and the second passages 5 and 6 is substantially zero. If connecting passages connecting the first and the second passages 5 and 6 are provided in the intermediate walls, water does not flow through the connecting passages and the intermediate walls 14*a*–14*c* are not cooled sufficiently.

In the present system, the first and the second passages 5 and 6 are connected to each other in series. When the power for the pump is identical, the amount of water flowing through the system is twice the amount in the known system. Accordingly, the walls 16*a*–16*d* are cooled sufficiently and uniformly. The pressure difference between the first and the second passages 5, 6 ensures that the water flows through the connecting passages 15*a*–15*c* sufficiently cooling the intermediate walls 14*a*–14*c*.

In the present system, the first passage 5 is formed on the side of the intake ports 1*a* and the second passage 6 is formed on the side of the exhaust ports 1*b*. Since water flows through the first passage 5 and then through the second passage 6, the temperature of the water in the first passage 5 is lower than the temperature of the water in the second passage 6. Therefore, the intake ports, and the intake air flowing therethrough, are cooled by water flowing through the first passage 5, which is at relatively low temperature, enhancing a trapping efficiency of the engine.

As shown in FIG. 2, the top portions of the first and the second passages are respectively closed by the cylinder block 3 itself. Alternatively, the top portions of the first and the second passages may be open and be closed by the gasket 2.

Figure 4:
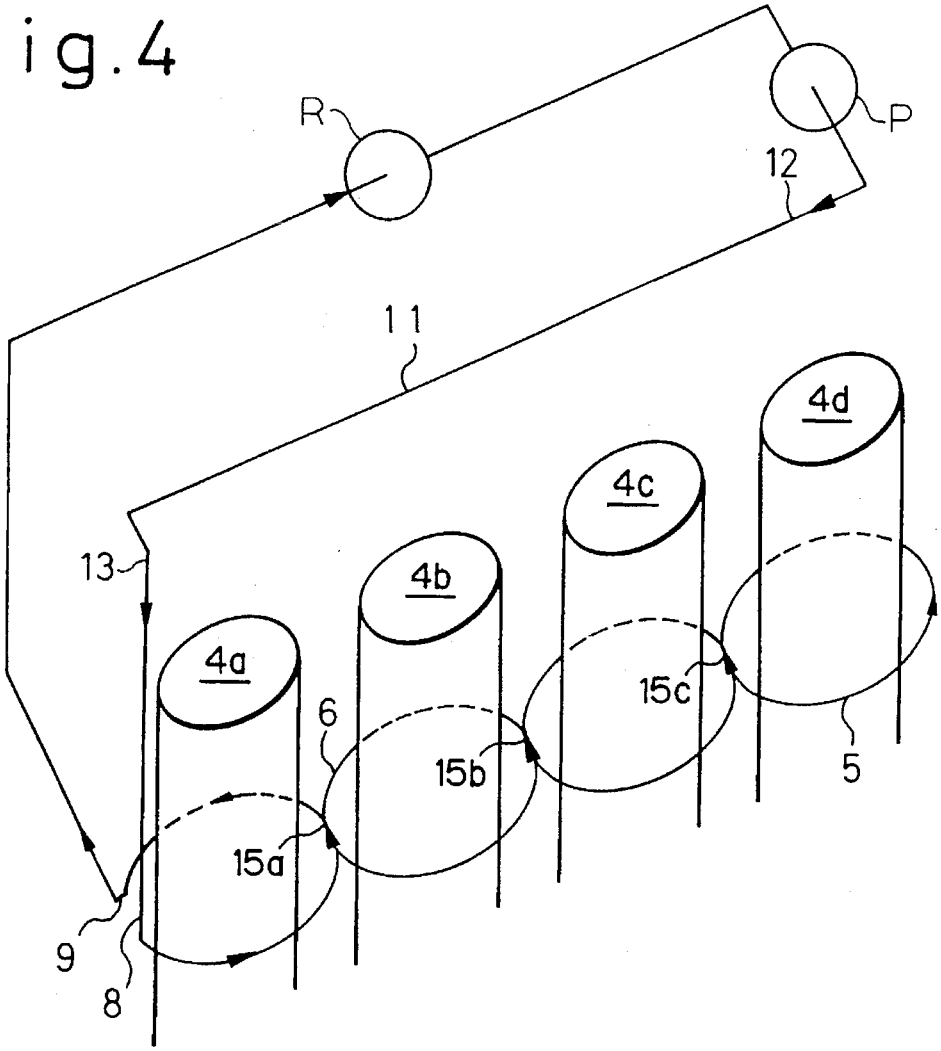
FIG. 4 is a schematic illustration showing a water flow in the system, according to a second embodiment of the present invention.

FIG. 4 shows a second embodiment of the present invention.

In the first embodiment described above, the outlet 9 is connected to the cylinder head passage inlet 12 so that water flows through, in turn, the first passage 5, the second passage 6, and the cylinder head passage 11. In the second embodiment, as shown in FIG. 4, the cylinder head passage outlet 13 is connected to the inlet 8 so that water flows through, in turn, the cylinder head passage 11, the first passage 5, and the second passage 6.

The cylinder head shown in FIG. 1A and the cylinder block shown in FIG. 1C can be applied to the second embodiment. With this arrangement, the first and the second passages in FIG. 1C form the second and the first passages, respectively. The inlet and the outlet in FIG. 1C form the outlet and the inlet, respectively. The cylinder head passage inlet and the cylinder head passage outlet in FIG. 1A formed the cylinder head passage outlet and the cylinder head passage inlet, respectively. Further, the intake and the exhaust ports in FIG. 1A formed the exhaust and the intake ports, respectively. As shown in FIG. 4, water flowing out of the outlet 9 is introduced to the radiator R, and then to the pump P. The other constructions and operations of the system in this embodiment are the same as those in the first embodiment, and thus, the descriptions are omitted.

Figure 5:
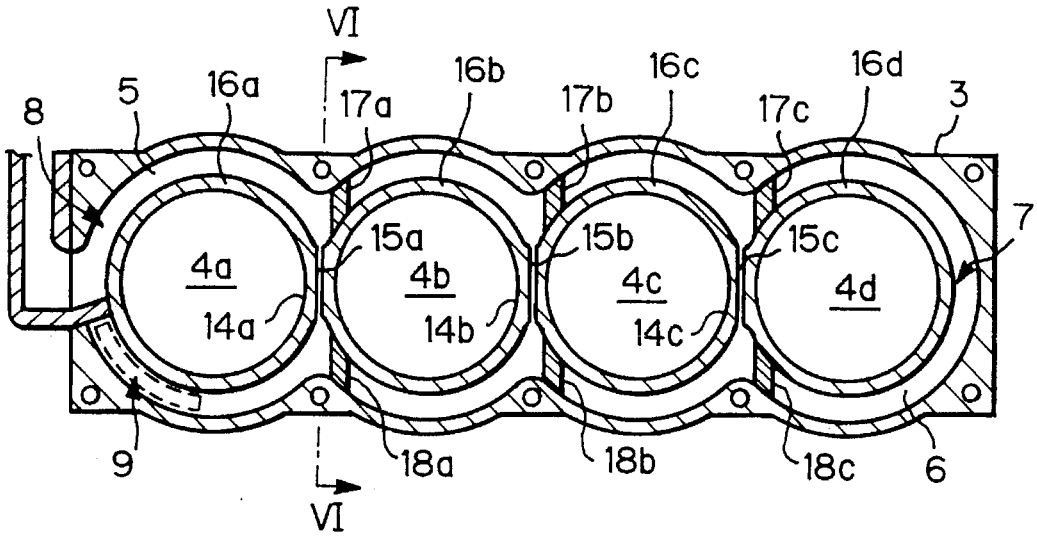
FIG. 5 is a cross sectional view of a cylinder block, according to a third embodiment of the present invention.
Figure 6:
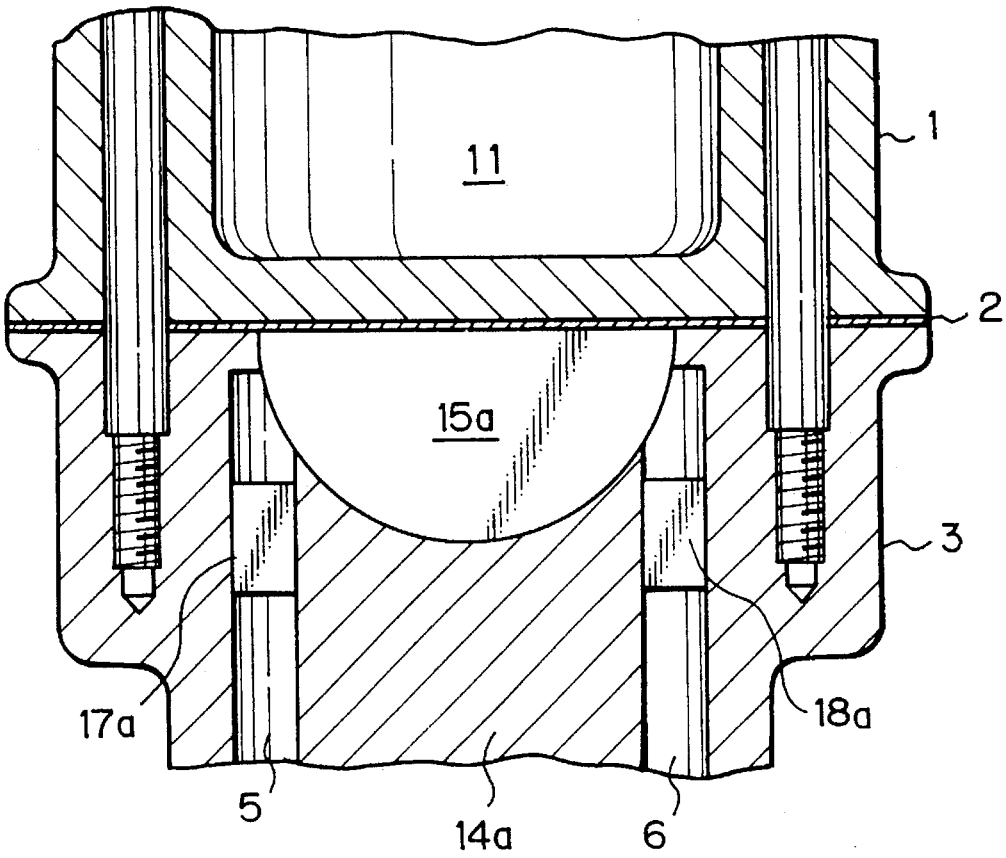
FIG. 6 is a cross sectional view of the cylinder head and cylinder block along the line VI—VI in FIG. 5.

FIGS. 5 and 6 show a third embodiment of the present invention.

Referring to FIGS. 5 and 6, a resisting member 17*a*, for increasing a flow resistance of the first passage 5, is arranged in the first passage 5, between the opening of the first connecting passage 15*a* and the opening of the second connecting passage 15*b*. Similarly, a resisting member 17*b* is arranged in the first passage 5, between the opening of the second connecting passage 15*b* and the opening of the third connecting passage 15*c* and a resisting member 17*c* is arranged in the first passage 5, between the openings of the third connecting passage 15*c*. Preferably, the resisting member 17*a*–17*c* are arranged just downstream of the opening of the corresponding connecting passage 15*a*–15*c*. The resisting members 17*a*–17*c* are fixed to the inner surface of the first passage 5.

A resisting member 18*a*, for increasing a flow resistance of the second passage 6, is arranged in the second passage 6, between the opening of the first connecting passage 15*a* and the opening of the second connecting passage 15*b*. Similarly, a resisting member 18*b* is arranged in the second passage 6, between the opening of the second connecting passage 15*b* and the opening of the third connecting passage 15*c*, and a resisting member 18*c* is arranged in the second passage 6, between the openings of the third connecting passage 15*c*. Preferably, the resisting members 18*a*–18*c* are arranged just downstream of the opening of the corresponding connecting passage 15*a*–15*c*. The resisting members 18*a*–18*c* are fixed to the inner surface of the second passage 6.

The resisting members 17*a*–17*c* reduce a flow area of the first passage 5 at their respective positions. The resisting members 18*a*–18*c* reduce a flow area of the second passage 6 at their respective positions. The resisting members 17*a*–17*c* and 18*a*–18*c* act as throttles. When water is formed to flow through the first and the second passages 5 and 6, the water pressure in the first passage 5 at the inlet of the first connecting passage 15*a* rises. The water pressure in the second passage 6 at the outlet of the first connecting passage 15*a* decreases. The pressure difference between the inlet and the outlet of the first connecting passage 15*a* increases. As a result, the amount of water flowing through the first connecting passage 15*a* increases and the intermediate wall 14*a* is cooled more effectively. Similarly, the pressure difference between the inlet and the outlet of the second connecting passage 15*b* and between the inlet and the outlet of the third connecting passage 15*c* increase and the intermediate walls 14*b* and 14*c* are also cooled more effectively.

As set forth above, the resisting members 17*a* and 18*a* are fixed to the cylinder walls 16*b*. These members 17*a* and 18*a* reinforce the wall 16*b* and thereby reduce the deformation of the bore 4*b*. Similarly, the resisting members 17*b* and 18*b*, which are attached to the wall 16*c*, and resisting members 17*c* and 18*c*, which are attached to the wall 16*d*, reinforce the corresponding walls and reduce the deformation of the bores 4*c* and 4*d*. The other constructions and operations of the system in this embodiment are the same as those in the first embodiment, and thus, the descriptions are omitted.

Figure 7:
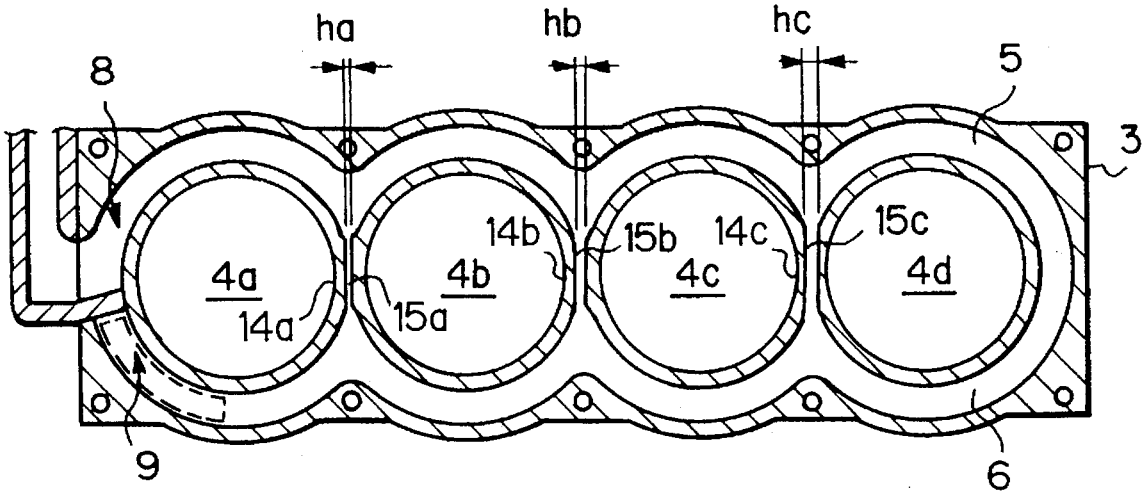
FIG. 7 is a cross sectional view of a cylinder block, according to a fourth embodiment of the present invention.
Figure 8A:
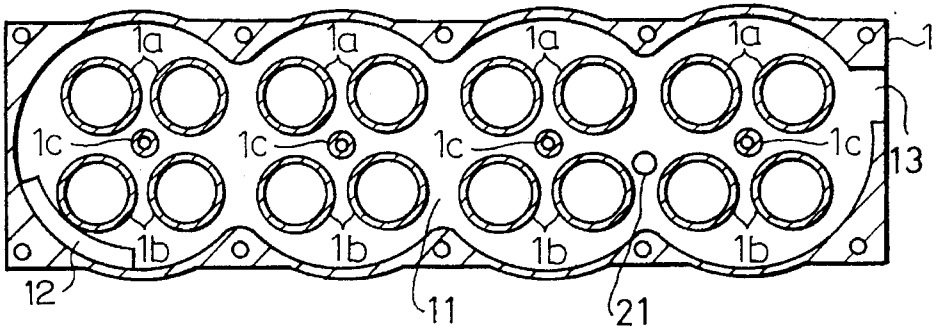
FIG. 8A is a cross sectional view of a cylinder head, according to a fifth embodiment of the present invention.
Figure 8B:
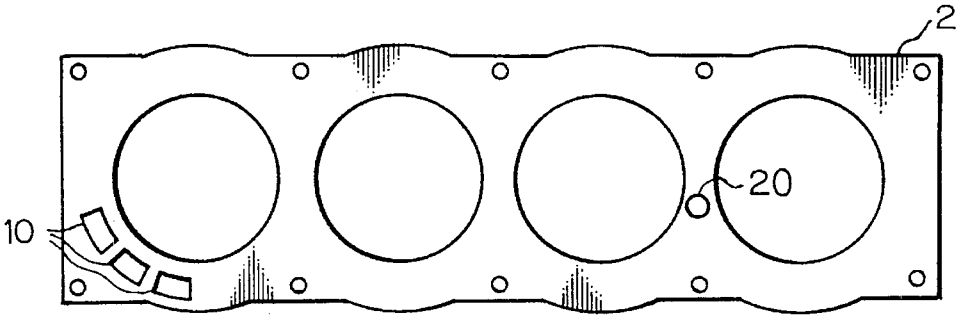
FIG. 8B is a top view of a gasket, according to the fifth embodiment of the present invention.
Figure 8C:
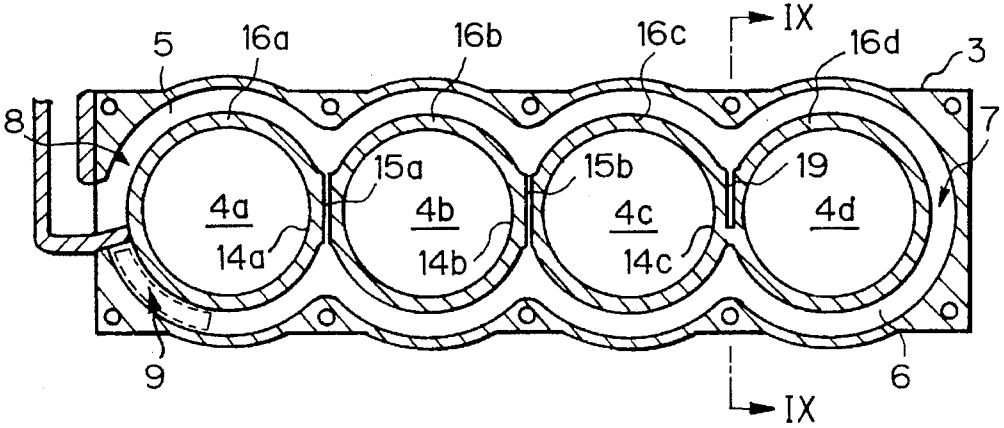
FIG. 8C is a cross sectional view of a cylinder block, according to the fifth embodiment of the present invention.

FIG. 7 shows a fourth embodiment of the present invention.

In the embodiments described above, the widths of the connecting passages 15*a*–15*c* are substantially the same. In this embodiment, the width of the second connecting passage hb is larger than the width of the first connecting passage ha and the width of the third connecting passage hc is larger than the width of the second connecting passage hb.

The depths of the connecting passages 15*a*–15*c* are substantially the same. The flow resistance of the connecting passages 15*a*–15*c* decreases as the distance between the inlet 8 and the connecting passage increases. In other words, the flow area of the connecting passages 15*a*–15*c* increases as the distance between the inlet 8 and the connecting passage increases.

The water pressure in the first passage 5 drops as the distance from the inlet 8 increases and the water pressure in the second passage 6 drops as the distance from the outlet decreases. As a result, the pressure difference between the inlet and the outlet of the connecting passage decreases as the distance between the inlet 8 and the connecting passage increases. If the flow areas of the connecting passages are substantially the same, the amount of water flowing therethrough decreases as the distance between the inlet 8 and the connecting passage increases. Accordingly, the cooling effect of the intermediate wall is reduced as the distance between the inlet 8 and the intermediate wall increases.

In this embodiment, however, the flow area of the connecting passage increases as the distance between the inlet and the connecting passage increases so that the cooling effect of the intermediate wall is not reduced as the distance between the inlet 8 and the intermediate wall increases. The amount of water flowing through the connecting passages can be made substantially the same and the intermediate walls 14*a*–14*c* cooled substantially uniformly. The other constructions and operations of the system in this embodiment are the same as those in the first embodiment, and thus, the descriptions are omitted.

FIGS. 8A, 8B, 8C, and 9 show a fifth embodiment of the present invention.

Referring to FIGS. 8A, 8B, 8C, and 9, the connecting passages 14*a* and 14*b*, the same as in the first embodiment, are provided in the corresponding intermediate walls 14*a* and 14*b* adjacent to the inlet 8. However, a conducting passage 19 for conducting coolant from the first passage 5 to the cylinder head passage 11 is formed in the intermediate wall 14*c*, which is furtherest from the inlet 8. The conducting passage 19 extends from the first passage 5 toward the second passage 6 over substantially the entire length of the intermediate wall 14*c*. The conducting passage 19 is connected to the cylinder head passage 11 via an aperture 20 formed in the gasket 2 and via an opening 21 formed in the cylinder head 1.

When water is formed to flow through, in turn, the first passage 5, the second passage 6, and the cylinder head passage 11, the pressure in the second passage 6 is lower than the pressure in the first passage 5, and the pressure in the cylinder head passage 11 is lower than the pressure in the second passage 6. As a result, a large pressure difference is obtained between the first passage 5 and the cylinder head passage 11. In the first embodiment, the intermediate wall 14*c*, which is furthest from the inlet 8, is not cooled sufficiently, since the amount of water flowing through the connecting passage 15*c* is relatively small.

In this embodiment, in order to cool the intermediate wall 14*c* sufficiently, the conducting passage 19 is formed extending between the first passage 5 and the cylinder head passage 11. The pressure difference between the first passage 5 and the cylinder head passage 11 is relatively large ensuring that a large amount of water flows through the conducting passage 19. This arrangement ensures sufficient cooling of the intermediate wall 14*c*.

Figure 9:
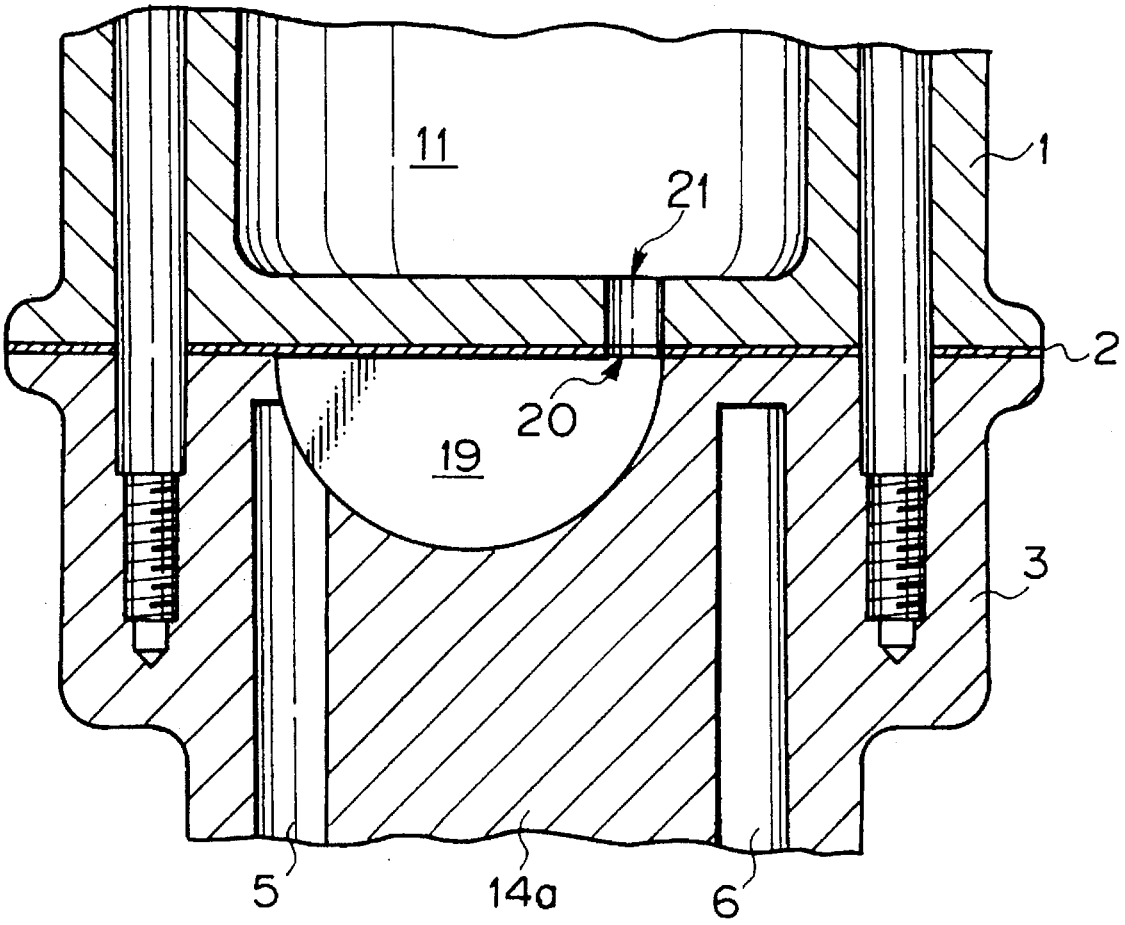
FIG. 9 is a cross sectional view of the cylinder head and the cylinder block along the line IX—IX in FIG. 8.
Figure 10:
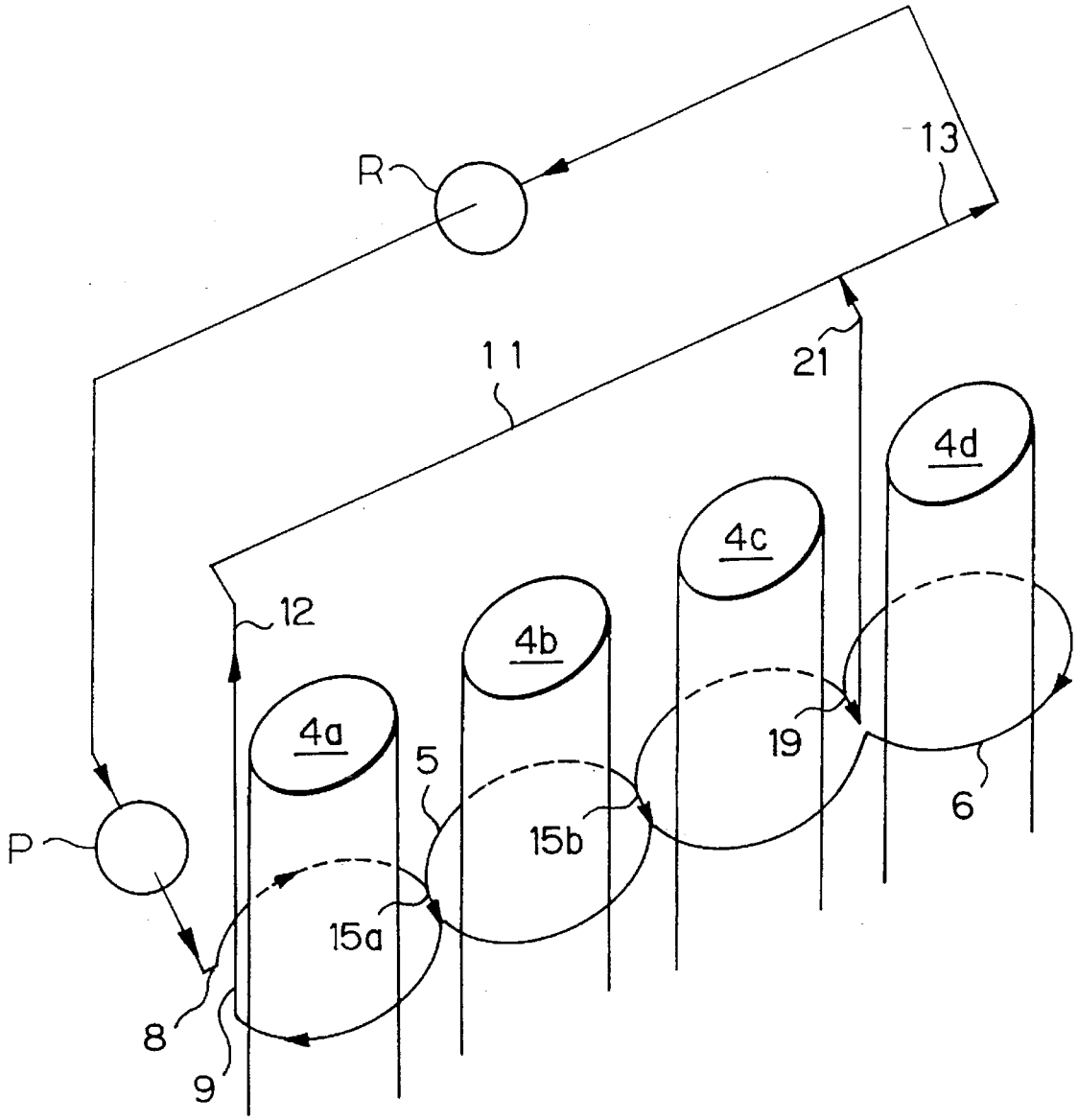
FIG. 10 is a schematic illustration showing a water flow in the system, according to the fifth embodiment of the present invention.
Figure 11A:
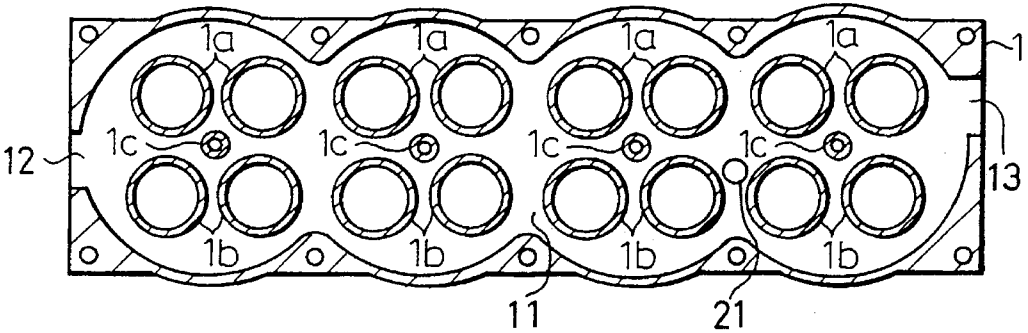
FIG. 11A is a cross sectional view of a cylinder head, according to a sixth embodiment of the present invention.
Figure 11B:
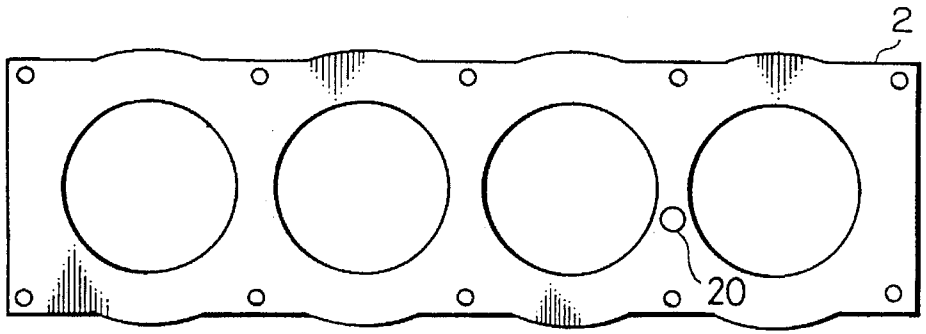
FIG. 11B is a top view of a gasket, according to the sixth embodiment of the present invention.
Figure 11C:
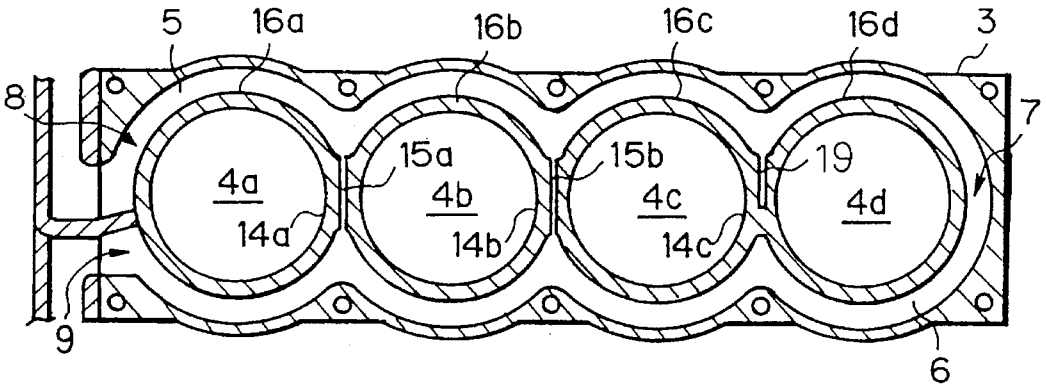
FIG. 11C is a cross sectional view of a cylinder block, according to the sixth embodiment of the present invention.
Figure 12:
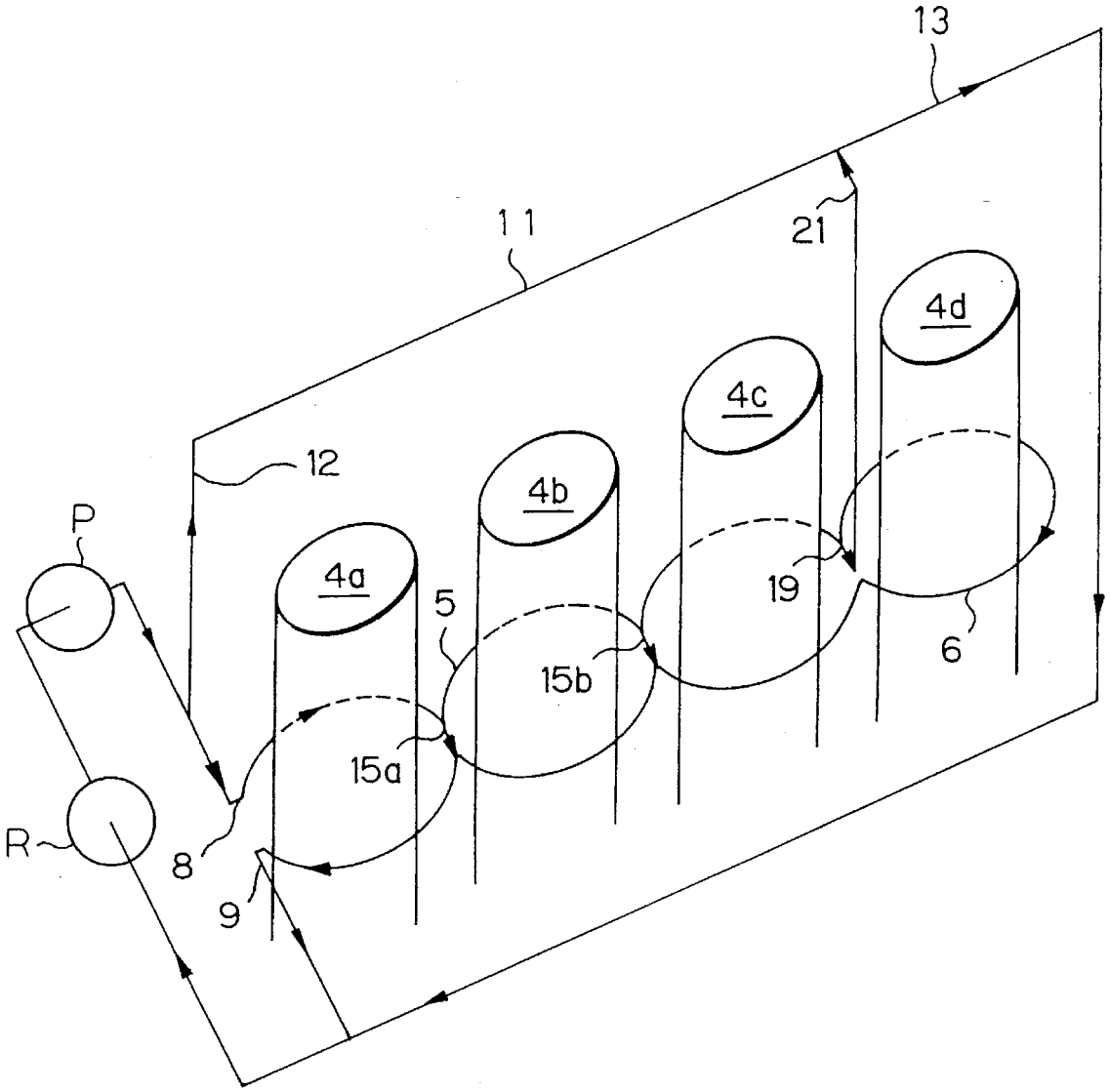
FIG. 12 is a schematic illustration showing a water flow in the system, according to the sixth embodiment of the present invention.

The opening 21 is located directly above the conducting passage 19, as shown in FIG. 9 so that the length of the conducting passage 19 does not need to be larger than the length of the connecting passage 15*c* in the first embodiment. The conducting passage 19 is able to cool the intermediate wall 14*c* sufficiently without increasing the flow resistance of the conducting passage 19. FIG. 9 illustrates the water flow in the system of this embodiment.

In the fifth embodiment described above, the conducting passage 19 extends in the intermediate wall 14*c* between the first passage 5 and the cylinder head passage 11. Alternatively, the conducting passage 19 may extend in the intermediate wall 14*c* from the second passage 6 toward the first passage 5 over the substantially entire length of the intermediate wall 14*c* and may be connected to the cylinder head passage 11. The pressure difference between the inlet and the outlet of the conducting passage is relatively large, and thus, sufficient cooling of the intermediate wall 14*c* results. The other constructions and operations of the system in this embodiment are the same as those in the first embodiment, and thus, the descriptions are omitted.

FIGS. 11A, 11B, 11C and 12 show a sixth embodiment of the present invention. In this embodiment, the conducting passage 19, as in the fifth embodiment, is provided in the intermediate wall 14*c*.

Referring to the figures, the cylinder head passage inlet 12 is arranged at the end of the cylinder head 1, and is connected to the pump outlet. The inlet 8 is also connected to the pump outlet. Water pumped by the pump P flows into both the inlet 8 and the cylinder head passage inlet 12. The outlet 9 and the cylinder head passage outlet 13 are connected to the radiator. The first and the second passage 5, 6 and the cylinder head passage 11 are connected in parallel.

The pressure drop in the cylinder head passage 11 is relatively large. Therefore, the pressure in the cylinder head passage 11 is low enough to allow water to flow through the conducting passage 19 from the first passage 5 to the cylinder head passage 11, even when the first and the second passage 5, 6 and the cylinder head passage 11 are connected in parallel. Accordingly, the intermediate wall 14*c* is sufficiently cooled. The other constructions and operations of the system in this embodiment are the same as those in the fifth embodiment, and thus, the descriptions are omitted.

FIGS. 13A, 13B, 13C and 14 show a seventh embodiment of the present invention.

Referring to the figures, conducting passages 22*a*, 22*b* and 22*c*, which are similar to the conducting passage 19 in the fifth embodiment, are provided in corresponding intermediate walls 14*a*, 14*b* and 14*c*. The conducting passages 22*a*, 22*b* and 22*c* extend in the corresponding intermediate walls 14*a*, 14*b* and 14*c* from the first passage 5 toward the second passage 6. They are connected to the cylinder head passage 11 via corresponding apertures 23*a*, 23*b* and 23*c* formed in the gasket 2 and corresponding openings 24*a*, 24*b* and 24*c* formed in the cylinder head 1.

In this embodiment, the outlet 9 is connected to the cylinder head passage inlet 12 so that water flowing through the first passage 5 next flows through the second passage 6, and then flows through the cylinder head passage 11 ensuring the relatively large pressure difference between the first passage 5 and the cylinder head passage 11. The amount of water flowing through the respective conducting passages 22*a*–22*c* is enough to cool the corresponding intermediate walls 14*a*–14*c*.

In the seventh embodiment described above, each of the conducting passages 22*a*–22*c* extend in the corresponding intermediate wall 14*a*–14*c* between the first passage 5 and the cylinder head passage 11. Alternatively, each of the conducting passages 22a–22c may extend in the corresponding intermediate wall 14a–14c from the second passage 6 toward the first passage 5 over the substantially entire length of the intermediate wall. With this construction, the pressure difference between the inlet and the outlet of the conducting passage is also relatively large resulting in sufficient cooling of the intermediate wall 14c. The other constructions and operations of the system in this embodiment are the same as those in the first embodiment, and thus, the descriptions are omitted.

Figure 15:
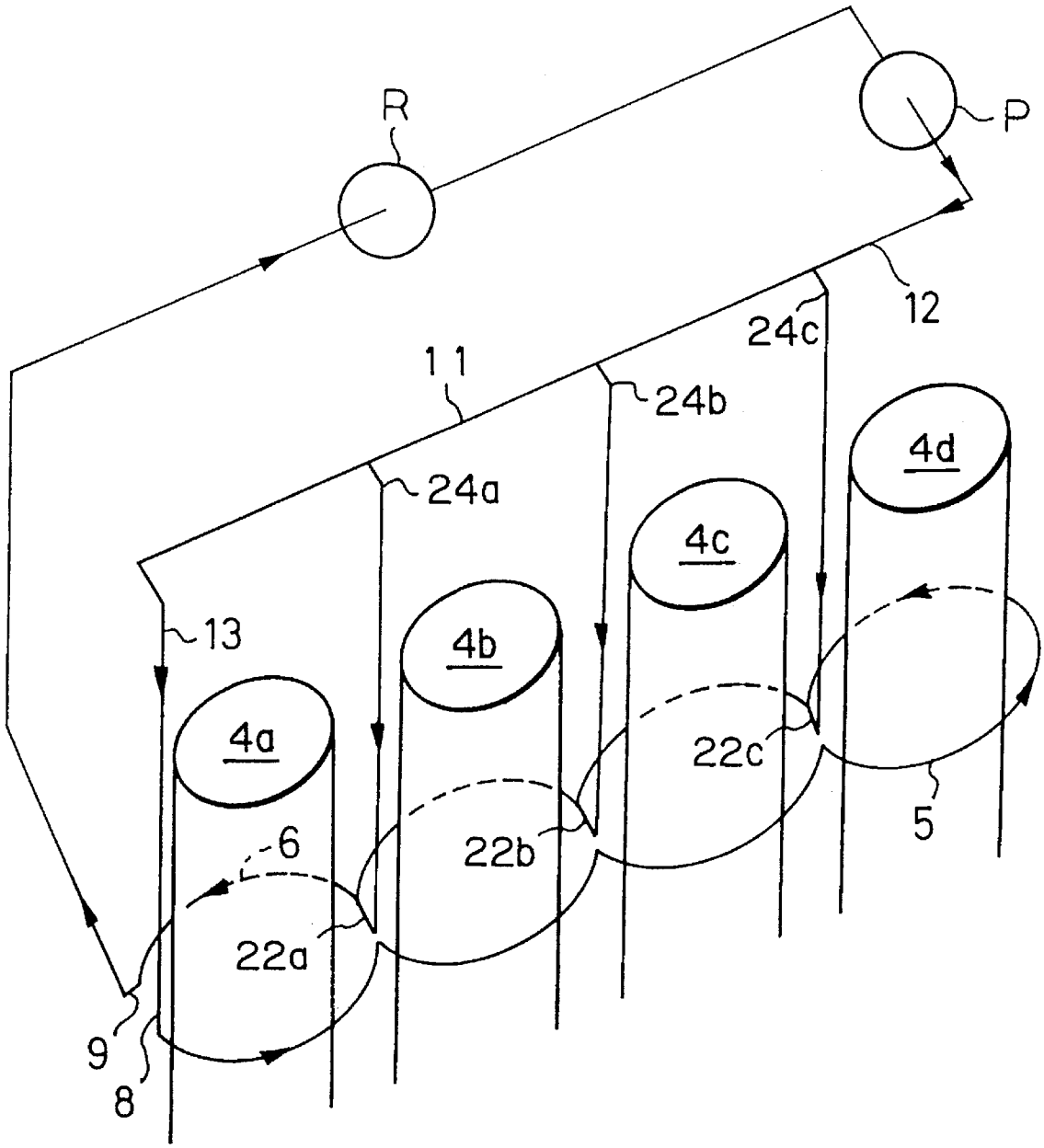
FIG. 15 is a schematic illustration showing a water flow in the system, according to an eighth embodiment of the present invention.

FIG. 15 shows an eighth embodiment of the present invention.

In the seventh embodiment described above, the outlet 9 is connected to the cylinder head passage inlet 12 so that water flows through, in turn, the first passage 5, the second passage 6, and the cylinder head passage 11. In this embodiment, as shown in FIG. 15, the cylinder head passage outlet 13 is connected to the inlet 8 so that water flows through, in turn, the cylinder head passage 11, the first passage 5, and the second passage 6.

Figure 13A:
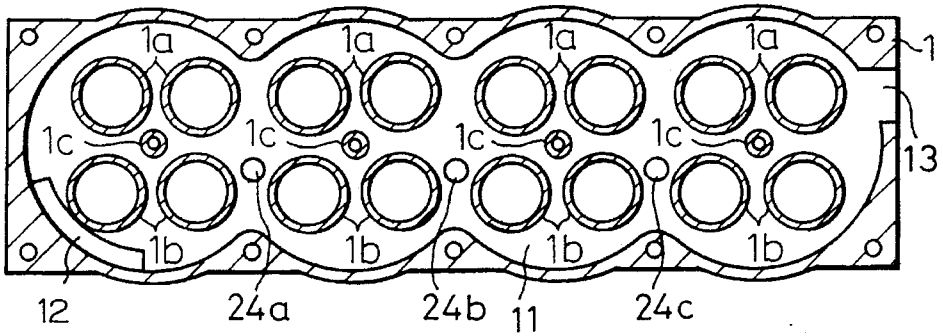
FIG. 13A is a cross sectional view of a cylinder head, according to a seventh embodiment of the present invention.
Figure 13B:
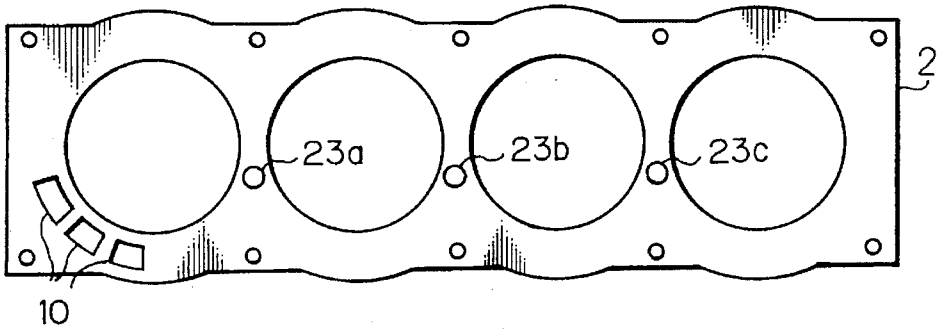
FIG. 13B is a top view of a gasket, according to the seventh embodiment of the present invention.
Figure 13C:
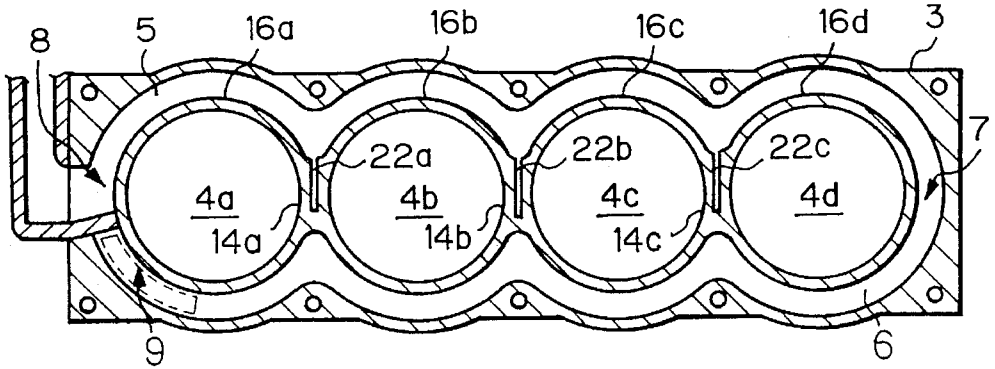
FIG. 13C is a cross sectional view of a cylinder block, according to the seventh embodiment of the present invention.
Figure 14:
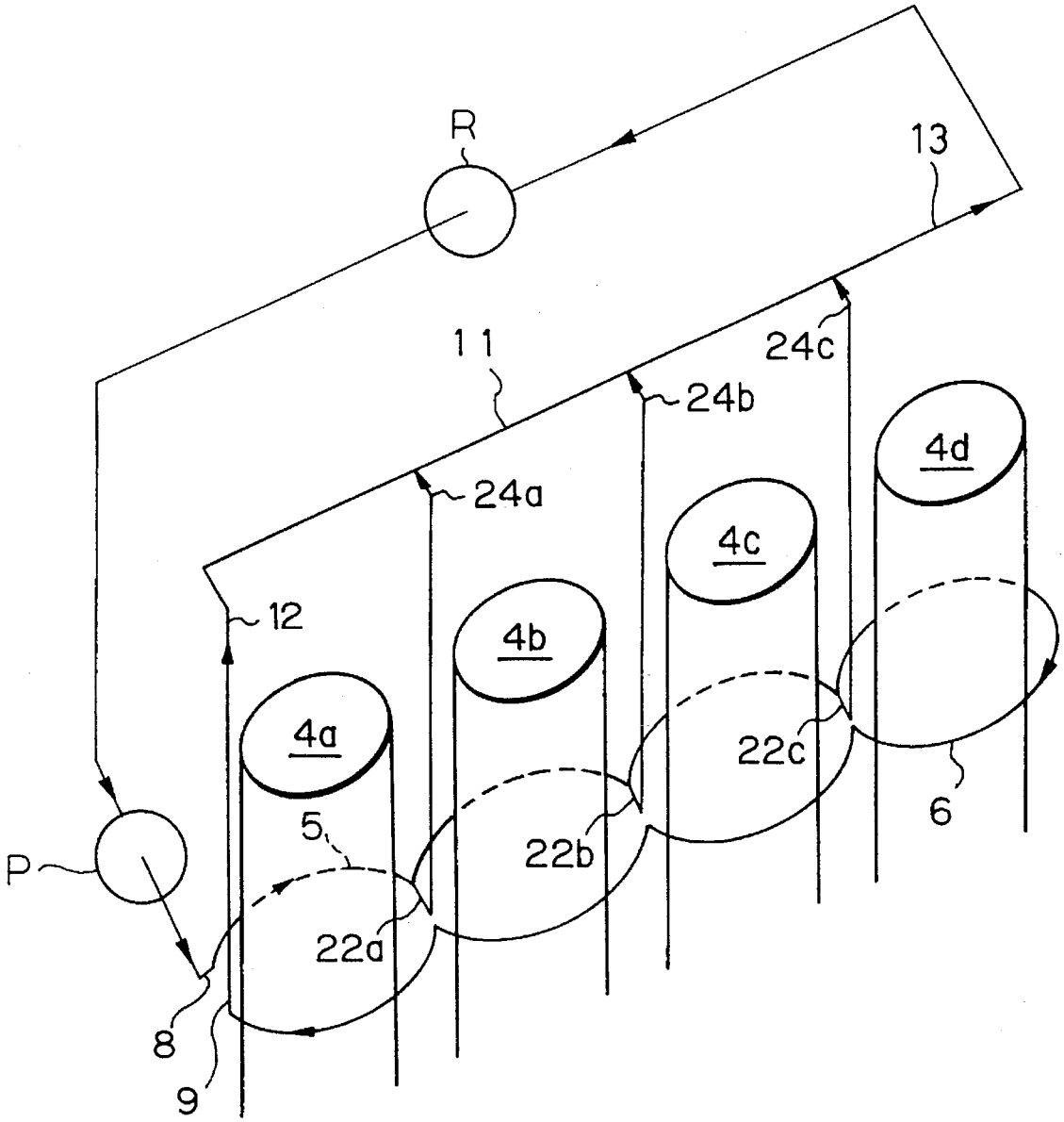
FIG. 14 is a schematic illustration showing a water flow in the system, according to the seventh embodiment of the present invention.

The cylinder head shown in FIG. 13A and the cylinder block shown in FIG. 13C can be applied to this embodiment. The first and the second passages in FIG. 13C form the second and the first passages, respectively. The inlet and the outlet in FIG. 13C form the outlet and the inlet, respectively. The cylinder head passage inlet and the cylinder head passage outlet in FIG. 13A force the cylinder head passage outlet and the cylinder head passage inlet, respectively. Further, the intake and the exhaust ports in FIG. 13A form the exhaust and the intake ports, respectively. Water flows through each of the conducting passages 22a–22c from the cylinder head passage 11 to the second passage 6 ensuring a large pressure difference between the cylinder head passage 11 and the second passage 6 and sufficient cooling of the intermediate walls 14a–14c. The other constructions and operations of the system in this embodiment are the same as those in the seventh embodiment, and thus, descriptions are omitted.

Figure 16:
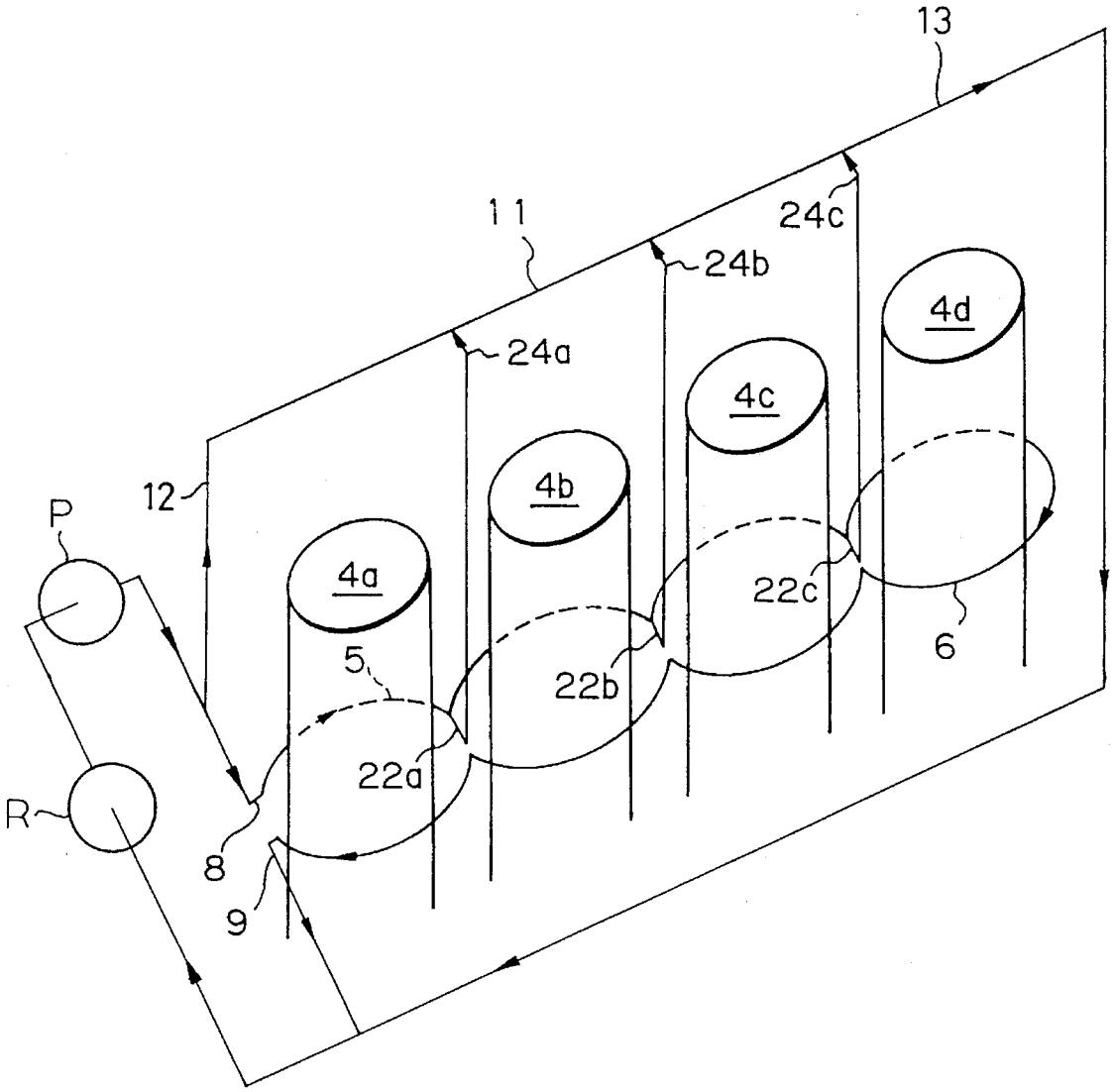
FIG. 16 is a schematic illustration showing a water flow in the system, according to a ninth embodiment of the present invention.
Figure 17A:
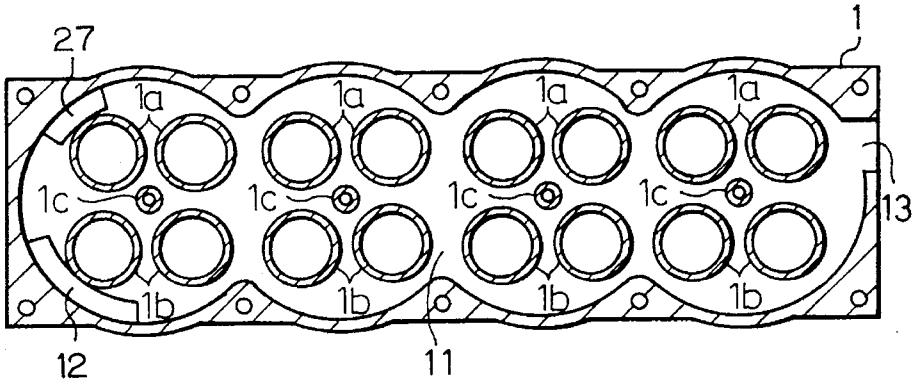
FIG. 17A is a cross sectional view of a cylinder head, according to a tenth embodiment of the present invention.
Figure 17B:
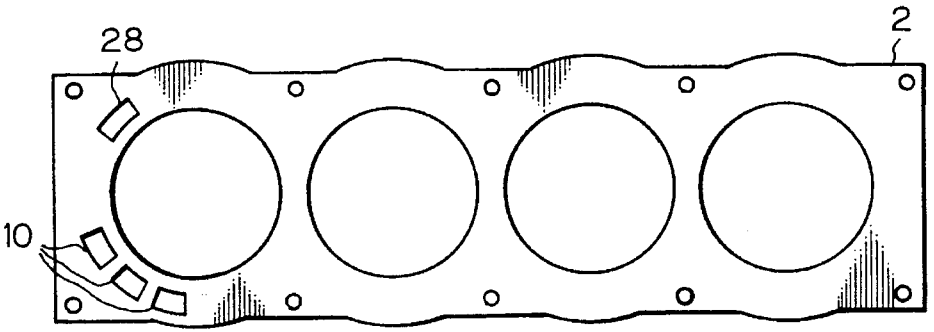
FIG. 17B is a top view of a gasket, according to the tenth embodiment of the present invention.
Figure 17C:
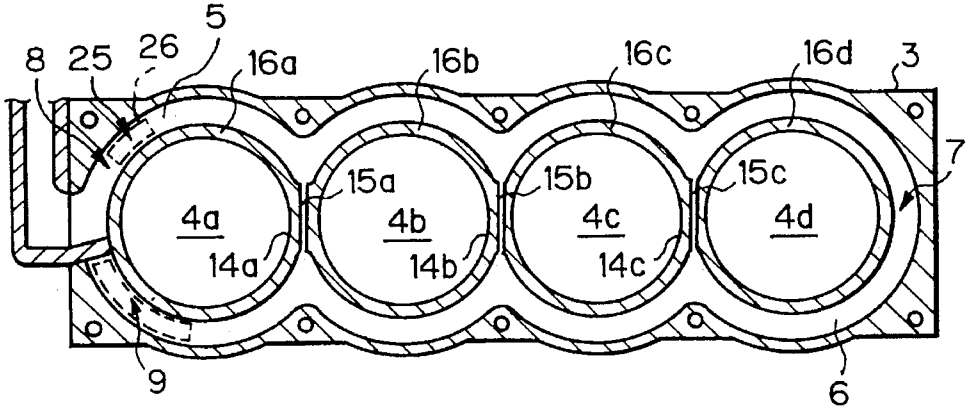
FIG. 17C is a cross sectional view of a cylinder block, according to the tenth embodiment of the present invention.
Figure 18:
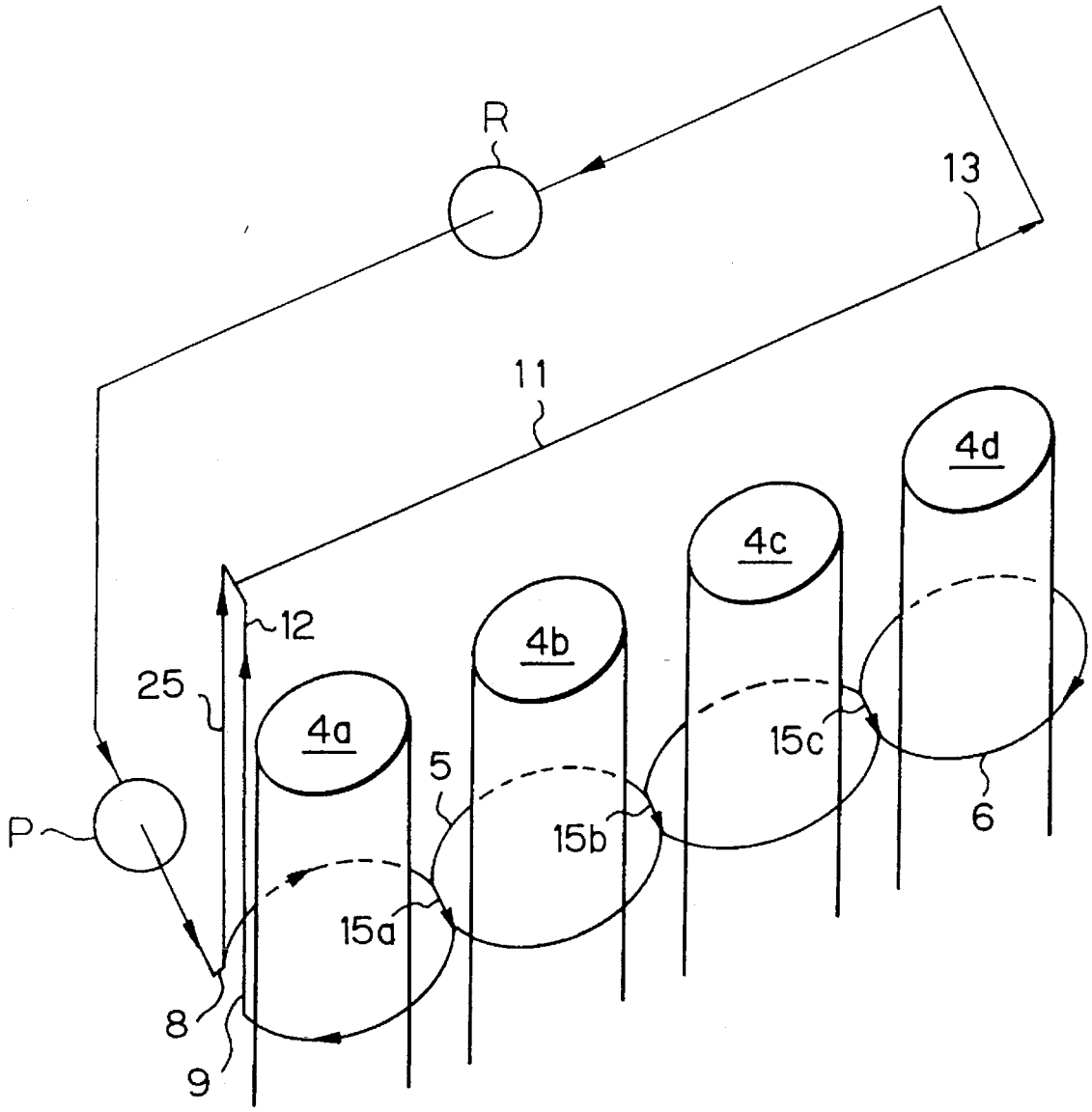
FIG. 18 is a schematic illustration showing a water flow in the system, according to the tenth embodiment of the present invention.

FIG. 16 shows a ninth embodiment of the present invention.

Referring to FIG. 16, both the cylinder head passage inlet 12 and the inlet 8 are connected to the pump outlet. Water pumped by the pump P flows into both of the inlet 8 and the cylinder head passage inlet 12. Both the outlet 9 and the cylinder head passage outlet 13 are connected to the radiator. The first and the second passage 5, 6 and the cylinder head passage 11 are connected in parallel as in the sixth embodiment.

The pressure in the cylinder head passage 11 is low enough to allow water to flow through the conducting passage 19 from the first passage 5 to the cylinder head passage 11, even when the first and the second passage 5, 6 and the cylinder head passage 11 are connected in parallel. Accordingly, the intermediate walls 14a–14c are sufficiently cooled. The other constructions and operations of the system in this embodiment are the same as those in the seventh embodiment, and thus, the descriptions are omitted.

FIGS. 17A, 17B, 17C and 18 show a tenth embodiment of the present invention.

Referring to the figures, a bypass passage 25 connects the inlet 8 to the cylinder head passage 11. An inlet 26 of the bypass passage 25 is formed in the cylinder block 3, and an outlet 27 of the bypass passage 25 is formed in the cylinder head 1. The bypass passage 25 passes through an aperture 28 formed in the gasket 2.

As shown in the figures, the outlet 27 of the bypass passage 25 is adjacent to the cylinder head passage inlet 12. If the water pressures at the cylinder head passage inlet 12 and at the outlet 27 of the bypass passage 25 are substantially the same, and the water pressures at the outlet 27 of the bypass passage 25 and at the inlet 26 of the bypass passage 25 are also substantially the same, water will not flow in the first and the second passages 5, 6. However, the aperture 28 acts as a throttle for reducing the water pressure at the outlet 27 of the bypass passage 25 so that the flow in the first and the second passages 5, 6 is not prevented.

In this embodiment, the quantity of heat which is to be removed from the cylinder block 3 by water is about 30–40% of a total quantity of heat which is to be removed from both the cylinder head 1 and the cylinder block 3. When about 40% in volume of water of the total water pumped by the pump operates for cooling the cylinder block 3, sufficient cooling of the cylinder block 3 can be obtained.

The aperture 28 is dimensioned so that about 40% in volume of water of the total water pumped by the pump flows through the first and the second passages 5, 6, and the reminder flows through the cylinder head passage 11 via the bypass passage 25. The pressure drop between the inlet 8 and the outlet 9 through the first and the second passage 5 and 6 is reduced as compared to the first embodiment, and the pressure drop between the inlet 8 and the cylinder head passage outlet 13 through the first and the second passages 5, 6 and the cylinder head passage 11 is reduced. As a result, the amount of water flowing therethrough can be increased without having to improve the performance of the pump. Further, the cooling ability in the cylinder block 3 is not reduced, while the cooling ability in the cylinder head 1 is enhanced.

In the tenth embodiment, the aperture 28 serves as a throttle. Alternatively, the opening 27 may serve as a throttle. Also, the opening 27 may be dimensioned so that the ratio between the amount of water flowing through the first and the second passages 5, 6 and the amount of water flowing through the opening 27 is predetermined.

According to the present invention, it is possible to cool the intermediate walls as well as the cylinder wall sufficiently, thereby reducing deformation of the cylinder bores.

While the invention has been described by reference to specific embodiments chosen for purposes of illustration, it should be apparent that numerous modifications could be made thereto by those skilled in the art without departing from the basic concept and scope of the invention.

We claim:

1. A cooling system for an engine having a plurality of cylinder bores which are arranged along a longitudinal axis of the engine, an intermediate wall being provided between every two adjacent bores, the system comprising:

a first coolant passage continuously extending, on one side of the axis, from the bore arranged in one end of the engine to the bore arranged in another end of the engine along the periphery of the bores;

a second coolant passage continuously extending, on another side of the axis, from the bore arranged in the one end of the engine to the bore arranged in the other end of the engine along the periphery of the bores;

a connector for connecting ends of the first and second coolant passages located at the one end of the engine;

a coolant inlet formed at the end of the first coolant passage located at the other end of the engine;

a coolant outlet formed at the end of the second coolant passage located at the other end of the engine; and a connecting passage formed in at least one intermediate wall for connecting the first and the second coolant passages to each other, wherein a coolant flows from the coolant inlet through, in turn, the first coolant passage, the connector, and the second coolant passage, and flows out from the coolant outlet, wherein the coolant flows through the connecting passage, and wherein an amount of coolant flowing through the first coolant passage, the connector, and the second coolant passage is substantially constant over these passages.

2. The system according to claim 1, wherein a connecting passage is provided in every intermediate wall.

3. The system according to claim 2, further comprising a resisting member arranged at least one position in either the first or the second coolant passage, the position being located between two adjacent openings, next to each other, of the connecting passages, for increasing the flow resistance in either the first or the second coolant passage respectively.

4. The system according to claim 3, wherein the resisting member is a rib fixed to a wall defining either the first or the second coolant passage, the rib decreasing an area of either the first or the second coolant passage.

5. The system according to claim 3, wherein the resisting member is arranged substantially just downstream of an opening of the connecting passage in the first coolant passage.

6. The system according to claim 3, wherein the resisting member is arranged substantially just upstream of an opening of the connecting passage in the second coolant passage.

7. The system according to claim 1, the engine having at least three bores so that at least two intermediate walls are provided, wherein connecting passages are provided in at least two intermediate walls.

8. The system according to claim 7, wherein the connecting passages are structured such that a flow resistance of the connecting passage becomes smaller as the distance between the inlet and the connecting passage becomes larger.

9. The system according to claim 8, wherein the connecting passages are structured such that an area of the connecting passage becomes larger as a distance between the inlet and the connecting passage becomes larger.

10. The system according to claim 7, the engine further having a cylinder head, the system further comprising a cylinder head coolant passage formed in the cylinder head, and a conducting passage formed in one of the at least two intermediate walls, which is farthest from the coolant inlet, for connecting either the first or the second coolant passage and the cylinder head coolant passage, the conducting passage extending from either the first or the second coolant passage over a majority of the length of the intermediate wall, and to the cylinder head coolant passage.

11. The system according to claim 1, the engine further having a cylinder head, the system further comprising a cylinder head coolant passage formed in the cylinder head, wherein the coolant outlet is connected to a cylinder head passage inlet formed in the cylinder head coolant passage so that the coolant flowing out from the coolant outlet flows through the cylinder head coolant passage.

12. The system according to claim 11, further comprising a bypass passage provided at the other end of the engine for connecting the coolant inlet to the cylinder head coolant passage.

13. The system according to claims 12, wherein an area of the bypass passage is structured to provide a predetermined ratio between an amount of the coolant flowing into the coolant inlet and an amount of coolant flowing into the cylinder head coolant passage.

14. The system according to claim 1, the engine further having a cylinder head, the system further comprising a cylinder head coolant passage formed in the cylinder head, wherein a cylinder head passage outlet formed in the cylinder head is connected to the coolant inlet so that the coolant flowing out from the cylinder head passage outlet flows through the first and the second coolant passages.

15. The system according to claim 1, the engine further having a cylinder head, the system further comprising a cylinder head coolant passage formed in the cylinder head, and a pump for pumping the coolant, wherein an outlet of the pump is connected to both the coolant inlet and a cylinder head passage inlet formed in the cylinder head coolant passage.

16. The system according to claim 1, the engine further having a cylinder head, the system further comprising a cylinder head coolant passage formed in the cylinder head, wherein the coolant outlet and the coolant inlet are connected to each other via the cylinder head coolant passage, a radiator, and a pump so that the coolant is circulated in the system.

17. The system according to claim 1, the engine further having a cylinder head with intake ports formed therein, the intake ports being arranged on one side of the axis, wherein the first passage is formed on the side of the axis in which the intake ports are arranged.

18. The system according to claim 1, wherein the coolant is water.

19. A cooling system for an engine having a plurality of cylinder bores which are arranged along a longitudinal axis of the engine, an intermediate wall being provided between every two adjacent bores, the engine further having a cylinder head, the system comprising:

a first coolant passage continuously extending, on one side of the axis, from the bore arranged in one end of the engine along the periphery of the bores;

a second coolant passage continuously extending, on another side of the axis, from the bore arranged in the one end of the engine to the bore arranged in the other end of the engine along the periphery of the bores;

a connector for connecting ends of the first and the second coolant passages located at the one end of the engine;

a coolant inlet formed at the end of the first coolant passage located at the other end of the engine;

a coolant outlet formed at the end of the second coolant passage located at the other end of the engine;

a cylinder head coolant passage formed in the cylinder head; and a conducting passage formed in every intermediate wall for connecting either the first or the second coolant passage to the cylinder head coolant passage, each of the conducting passages extending from either the first or the second coolant passage over a majority of the length of the intermediate wall, and to the cylinder head passage, wherein a coolant flows from the coolant inlet through, in turn, the first coolant passage, the connector, and the second coolant passage, and flows out from the coolant outlet, and wherein the coolant flows through the conducting passages.

20. The system according to claim 19, wherein the coolant outlet is connected to a cylinder head passage inlet formed in the cylinder head coolant passage so that the coolant flowing out from the coolant outlet flows through the cylinder head coolant passage.

21. The system according to claim 20, wherein each conducting passage extends between the first coolant passage and the cylinder head coolant passage.

22. The system according to claim 19, wherein a cylinder head passage outlet formed in the cylinder head is connected to the coolant inlet so that the coolant flowing out from the cylinder head passage outlet flows through the first and the second coolant passages.

23. The system according to claim 22, wherein each conducting passage extends between the second coolant passage and the cylinder head coolant passage.

24. The system according to claim 19, further comprising a pump for pumping the coolant, wherein an outlet of the pump is connected to both the coolant inlet and a cylinder head passage inlet formed in the cylinder head passage.

25. The system according to claim 19, wherein the coolant outlet and the coolant inlet are connected to each other via the cylinder head passage, a radiator, and a pump so that the coolant is circulated in the system.

26. The system according to claim 19, the engine further having a cylinder head and intake ports formed therein, the intake ports being arranged on one side of the axis, wherein the first coolant passage is formed on the side of the axis in which the intake ports are arranged.

27. The system according to claim 19, wherein the coolant is water.

* * * * *